United States Patent [19]

Watkins

[11] 4,161,984

[45] Jul. 24, 1979

[54] WELL LOCKING DEVICE AND METHOD

[75] Inventor: Fred E. Watkins, Houston, Tex.

[73] Assignee: Camco, Incorporated, Houston, Tex.

[21] Appl. No.: 940,819

[22] Filed: Sep. 11, 1978

[51] Int. Cl.[2] ..... E21B 23/02

[52] U.S. Cl. ..... 166/315; 166/217; 285/140; 285/315

[58] Field of Search ..... 166/206, 208, 315, 123, 166/73, 178, 179, 217, 72; 285/39, 140, 315

[56] References Cited

U.S. PATENT DOCUMENTS

| | | | |
|---|---|---|---|
| 2,920,704 | 1/1960 | Fredd | 166/206 X |
| 3,090,438 | 5/1963 | Raulins | 166/208 X |
| 3,677,346 | 7/1972 | Tamplen | 166/315 |
| 3,893,717 | 7/1975 | Nelson | 166/208 X |
| 3,946,807 | 3/1976 | Amancharla et al. | 166/208 X |
| 4,051,896 | 10/1977 | Amancharla et al. | 166/208 X |

*Primary Examiner*—Stephen J. Novosad
*Attorney, Agent, or Firm*—Fulbright & Jaworski

[57] ABSTRACT

A well locking device and method of operation including a well lock and a landing nipple for locking well equipment in the production string of oil and/or gas wells. The well lock includes two sets of locking dogs, one of which locks the well lock in the landing nipple and holds against loads either from above or below the lock. The second set of locking dogs prevents the release of the well lock from the nipple when a pressure differential exists across the lock. A locking nipple includes first and second recesses and a stop shoulder and the coacting well lock includes a housing carrying first and second locking dogs in which the vertical spacing of the first and second locking dogs is less than the vertical distance between the tops of the first and second recesses. A seal is positioned on the exterior of the well lock housing and adapted to seal in the locking nipple, and locating means are provided on the housing for engaging the stop shoulder of the nipple. The lock can be released only by moving it downwardly and then upwardly, but any pressure below the lock sufficient to lift the lock back up after being moved downwardly will not allow the lock to be released.

10 Claims, 8 Drawing Figures

WELL LOCKING DEVICE AND METHOD

BACKGROUND OF THE INVENTION

There are various types of locking devices that are used to support equipment in the production string of oil and/or gas wells. Generally, these locks can be unlocked with a pressure differential existing across them. However, releasing a well lock under pressure with a wire line tool may cause the released lock and line to be blown up the hole creating a tangled mess of wireline which may cause a costly wireline fishing job and even pulling of the tubing string to remove the obstruction.

The present invention is directed to an improved method and apparatus for setting and releasing a well lock from a landing or locking nipple in oil and/or gas wells which may be subject to high pressures.

SUMMARY

The present invention is directed to a well locking device and method of setting and retrieving the lock from the tubing of a well in which the well lock has first and second locking means. The first locking means locks the lock in the tubing and holds against the loads applied either from below or above the well lock. The second locking means is actuated by the existence of high pressure in the tubing below the lock to normally prevent the well lock from being released.

A further object of the present invention is the provision of a well lock and a method of locking and releasing the lock in a bore of a tubing which has first and second recesses wherein the well lock includes a housing carrying first and second locking means and seal means positioned on the exterior of the housing and adapted to seal with the bore of the tubing. Locator means are positioned on the housing for positioning the first and second locking means aligned with the first and second recesses in the tubing. A mandrel is positioned for telescoping movement in the housing for locking and releasing the well lock. Shoulder means are provided on the mandrel for locking the first locking means in the first recess on longitudinal movement of the mandrel relative to the housing. Additional shoulder means are provided on the mandrel for engaging the second locking means for preventing unlocking of the first locking means if pressure is applied to the seal to move the housing upwardly.

A still further object of the present invention is the provision of the combination of a well lock and a locking nipple for use in a well tubing in which the locking nipple includes first and second recesses and a stop shoulder. The well lock includes the lock housing carrying first and second locking means in which the vertical spacing of the first and second locking means is less than the vertical distance between the tops of the first and second recesses. Seal means are positioned on the exterior of the housing for sealing in the locking nipple and locating means on the housing are provided for engaging the stop shoulder of the nipple for aligning the locking means with the recesses. A mandrel positioned in the housing is raised to place a locking shoulder behind the first locking means for holding the well lock against either upward or downward loads. A further shoulder on the mandrel is provided for engaging the second locking means if pressure is applied to the seal to move the housing upwardly forcing the second locking means out of the second recess and into engagement with the mandrel.

Yet a still further object of the present invention is the provision of a third locking shoulder on the mandrel above the second locking shoulder for insuring that the well tool is correctly aligned in the tubing prior to locking the well lock into the locking nipple.

Still a further object of the present invention is the provision of a method of locking and releasing a well lock in which the well lock is moved into a landing nipple having first and second recesses and first and second locking means on the well lock are aligned with the first and second recesses. A mandrel having a shoulder is moved relative to the first locking means to place the shoulder behind the first locking means to lock the well lock in the landing nipple. If the well pressure below the well lock is suffient to move the well lock upwardly, the second locking means is moved inwardly into engagement with the mandrel thereby holding the shoulder in a locked position behind the first locking means. In addition, the method includes releasing the locked well lock from the tubing nipple by moving the well lock downwardly to overcome any upward movement of the well lock because of well pressure and align the first and second locking means with the first and second recesses of the locking nipple. If the well lock remains in the downward position, the mandrel is raised to remove the shoulder from behind the first locking means thereby releasing the well lock from the nipple and thereafter retrieving the well lock from the nipple.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1A:
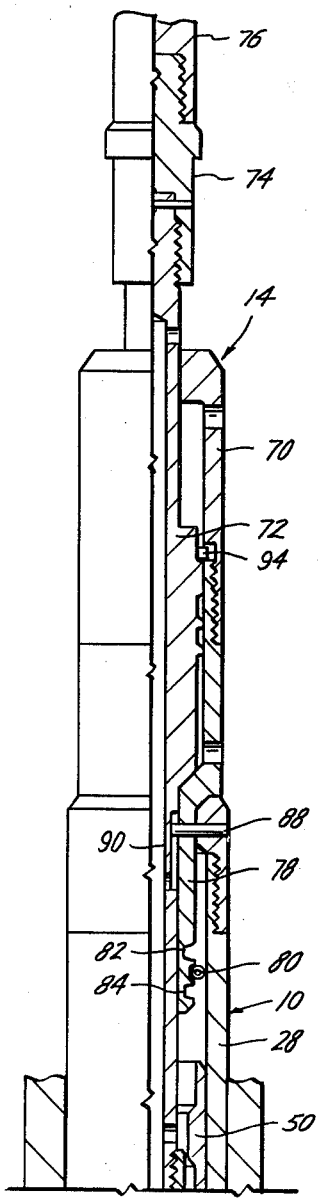
FIGS. 1A and 1B are continuations of each other of an elevational view, partly in cross section, of a well lock of the present invention being run into position in a locking nipple of the present invention.
Figure 1B:
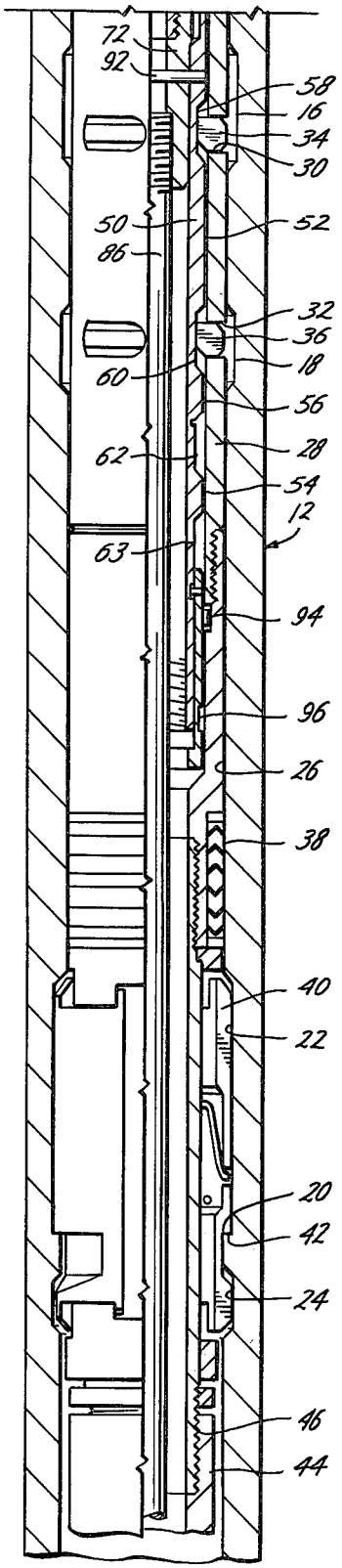

Referring now to the drawings, and in particular to FIGS. 1A and 1B, the reference numeral 10 generally indicates the well lock of the present invention being installed in a well production tubing such as in a landing or locking nipple generally indicated by the reference numeral 12 by means of a running tool generally indicated by the reference numeral 14 supported from a wireline (not shown) as is conventional.

The locking nipple 12 is positioned in the well tubing in the well bore and includes a first recess 16, a second recess 18 and suitable locating means such as a stop shoulder 20 for the purpose of stopping the well lock 10 in an aligned position in the nipple 12 although any other suitable locating means such as a no-go shoulder may be utilized and may include selector profile sections 22 and 24. In addition, the nipple 12 may include a polished section 26 for coacting with a seal on the well lock 10.

The well lock 10 generally includes a housing 28 and first openings 30 and second openings 32 for receiving first locking means 34 and second locking means 36, respectively, such as sets of locking dogs. The housing 28 also includes seal means 38 for sealing against the polished section 26 of the nipple 12. The housing 28 further includes suitable locating or stopping means such as conventional spring-loaded selector keys 40 which have a stop shoulder 42 for coacting with the stop shoulder 20 of the nipple 12. The keys 40 may have an exterior profile matching the profiles of sections 22 and 24 of the nipple 12 for selectively locating the well lock 10 in a particular nipple 12 as is conventional.

Normally the purpose of the well lock 10 is to support other equipment in the well tubing such as a well safety valve 44 which may be suitably connected to the housing 28 by a threaded connection 46.

The well tool 10 includes a locking and releasing mandrel 50 positioned for telescoping movement in the housing 28. The mandrel 50 includes a first locking shoulder 52 a second locking shoulder 54, and if desired a third shoulder 56 with suitable grooves therebetween such as groove 58, a second groove 60 and a third groove 62.

The running tool 14 may include a body 70, an actuating member 72 which is movable relative to the body 70 and is connected to a fishing neck 74 and in turn to a wireline connection 76 for actuation by a wireline. The body 70 includes a tattle tale housing 78 with a tattle tale garter spring 80 positioned thereon between upper groove 82 and lower groove 84 for indicating whether the lock 10 has been properly set as will be more fully discussed hereinafter. In the event that the lock 10 is suspending a safety valve 44 in the tubing, a pipe 86 may be connected to the actuating member 72 for holding the safety valve 44 in the open position. A first shear pin 88 is provided not only connecting the tool body 70 to the housing 28 of the well lock 10, but also extending from the body 70 into a groove 90 in the actuating member 72 thereby initially allowing a limited amount of upward movement of the actuating member 72 relative to the body 70. A second shear pin 92 is connected between the mandrel 50 and the actuating member 72 whereby the actuating member 72 may move the mandrel 50. In addition, a collet ring 94 initially holds the actuating member 72 downwardly relative to the body 70 of the setting tool 14 which in turn holds the mandrel 50 in the position shown in FIG. 1B with the locking dogs 34 and 36 retracted in the grooves 58 and 60, respectively.

As best seen in FIGS. 1A and 1B, the well lock 10 is lowered by the running tool 14 from a wireline through a well tubing in a well until the locator means such as the selector keys 40 having a stop 42 engage the stop shoulder 20 in the locking member 12 thereby aligning the first locking dogs 34 and the second locking dogs 36 in alignment with the recesses 16 and 18, respectively, of the locking nipple 12. And the seal 38 seals against the bore 26 of the nipple 12.

Figure 2A:
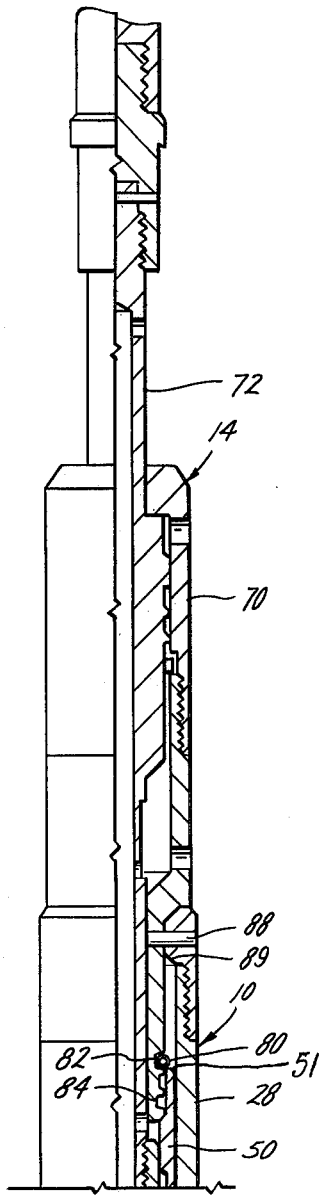
FIGS. 2A and 2B are continuations of each other of an elevational view, partly in cross section, of the apparatus of FIGS. 1A and 1B, but shown in the set position.
Figure 2B:
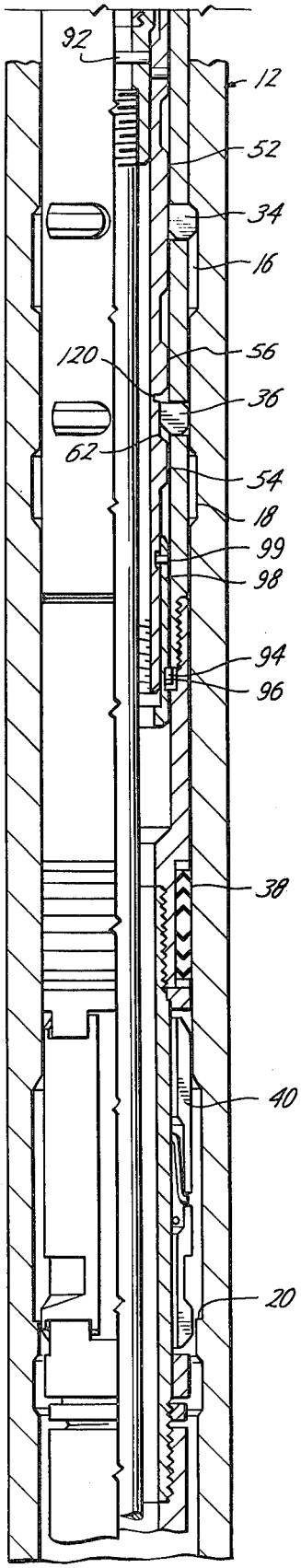

The well lock is now in position to be set by picking up on the wireline setting tool 14. The housing 28 of the well lock is frictionally held in the nipple 12 as the setting tool actuator 72 is moved upwardly relative to the body 70 overcoming the spring collet 94 allowing the groove 90 to move past the shear pin 88, and carrying the mandrel 50 upwardly relative to the housing 28 to move the shoulders 52 and 56 behind the locking dogs 34 and 36, respectively, to drive the dogs 34 and 36 outwardly into the recesses 16 and 18, respectively. Further upward movement of the actuator 72 shears the portion of the shear pin 88 in the groove 90 thereby carrying the mandrel 50, as best seen in FIGS. 2A and 2B, upwardly to move shoulder 56 past the lower locking dogs 36 and bring the lower locking dogs 36 into groove 62 and against the top of the shoulder 54 thereby carrying the housing 28 upwardly. However, the shoulder 52, because of its extent, remains positioned behind the locking dogs 34 and the housing 28 and mandrel 50 move upwardly until the locking dogs 34 engage the top of the recess 16 at which time the shear pin 92 between the actuator 72 and the mandrel 50 shears. If desired, the intermediate shoulder 56 may be omitted although it serves the purpose of forcing the lower set of locking dogs 36 outwardly into the recess 18 to doubly insure proper positioning of the well lock 10 relative to the nipple 12.

It is to be noted that prior to the shearing of pin 92 that the upper end 51 of the mandrel 50 engages the garter spring 80 moving it upwardly into the notch 82 thereby providing a tattle tale which may be visually observed when the running tool 70 is returned to the well surface to indicate that the lock was properly positioned. In the event that the upper mandrel end 51 did not contact the garter spring 80, the garter spring 80 would contact a shoulder 89 on the housing 28 moving the garter spring 80 instead to the groove 84 and upon removal of the running tool 70 would denote an improper lock setting.

Referring to FIG. 2B, a releasable locking connection is provided between the mandrel 50 and the housing 28 such as a C-ring 94 in the housing 28 which engages a groove 96 in the hold-down sleeve 98 which in turn is connected to the mandrel 50 by shear pin 99 thereby anchoring the mandrel 50 in the proper locked position.

The well lock 10 is properly locked in the position shown in FIGS. 2A and 2B. That is, the mandrel 50 is locked to the housing 28 and the shoulder 52 remains behind the dogs 34 keeping them locked in the recess 16 against loads applied either in an up or down direction. Furthermore, it is noted that the vertical spacing between the locking dogs 34 and 36 is less than the vertical distance between the tops of the first and second recesses 16 and 18 in the nipple 12 whereby a load, such as downhole pressure on the seal 38, causes upward movement to the lock 10, and the dogs 36 move out of the recess 18 and into the groove 62 causing the mandrel shoulder 54 to come into engagement with the lower side of the dogs 36 to prevent further upward movement of the mandrel 50. This insures that the dogs 34 remain locked in place. After the lock 10 is set in the nipple 12, an upper jar is then taken to jar the actuator 72 against the body 70 of the running tool to shear the pin 88 between the connection of the body 70 and the housing 28 thereby releasing the running tool 14 allowing it to be retrieved to the well surface.

Figure 3:
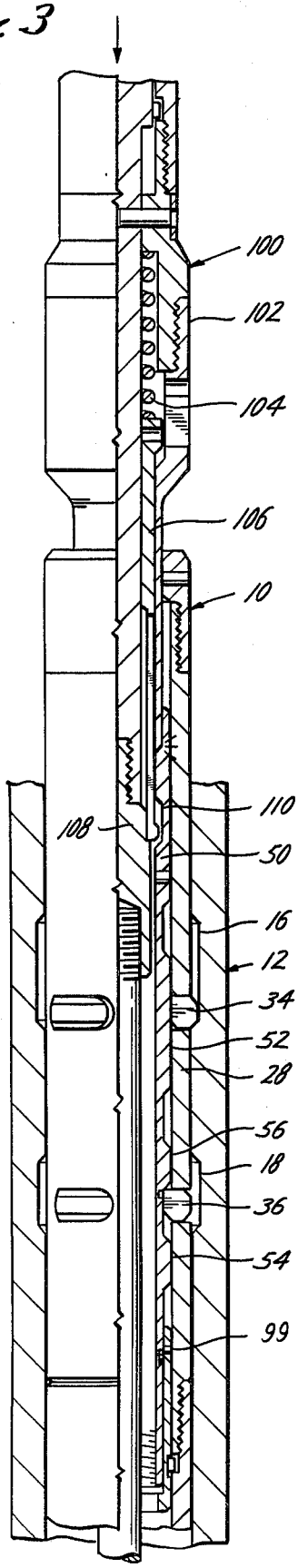
FIG. 3 is an elevational view, partly in cross section, of the top portion of the well lock and landing nipple in which a releasing tool is connected and the well lock is being moved downwardly preparatory for release from the landing nipple.

As had previously been indicated in order to remove a well lock from a nipple in the well bore, it is desirable to release the lock by an upward movement, but not in the event that a pressure differential exists across the well lock which would result in the lock being blown up the hole and tangling the wireline. In the normal operation of releasing the well lock 10 from the nipple 12 of the present invention, the lock 10 must be moved downwardly and must remain down before it can be released by an upward pull. If any pressure below the lock 10 is of a magnitude capable of lifting the lock 10 back up after it has been moved downwardly, the lock will not normally release. Referring now to FIG. 3, a pulling tool, generally indicated by the reference numeral 100, is provided for connection to the mandrel 50 for releasing the well tool 10 from the locking nipple 12. The pulling tool 100 includes a body 102, a spring 104 actuating downwardly a plurality of spring collets 106 to lock on a mandrel 108 to engage an inner groove 110 in the well lock mandrel 50 for pulling, and in which the lower end of the housing 102 can engage the upper end of the mandrel 50 for providing a downward jar. In FIG. 3, the pulling tool is jarring the mandrel 50 downwardly which shears the pins 99 and the locking dogs 34 and 36 are realigned with the recesses 16 and 18 in the nipple 12 and downward jarring is terminated. However, if there is any pressure below the lock 10 of a magnitude sufficient to lift the lock 10 back up after being moved downwardly, as shown in FIG. 3, the lock will move to the locked position shown in FIGS. 2A and 2B and remain locked. This insures that the lock 10 cannot be normally removed in the presence of a high differential pressure across the lock 10.

Figure 4:
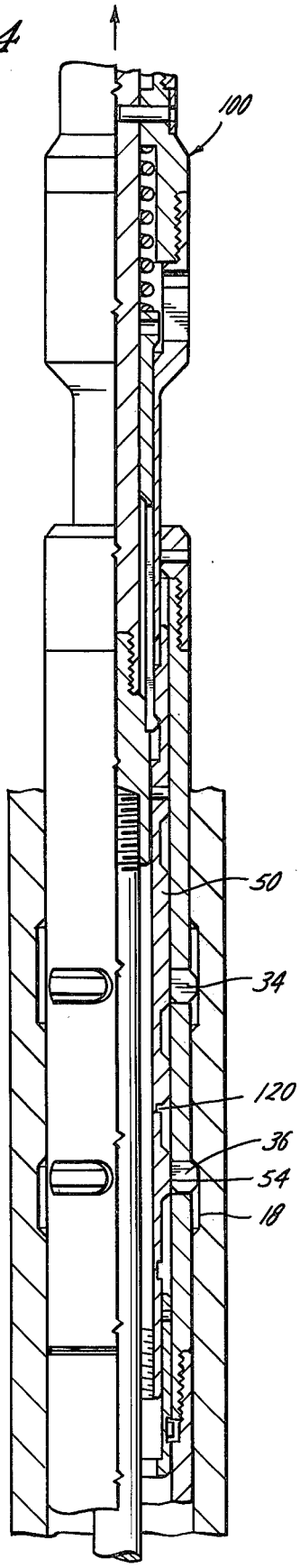
FIG. 4 is an elevational view, partly in cross section, of the portion of the apparatus of FIG. 3, in which an upward pull is now being taken on the well lock preparatory for release from the locking nipple.

In the event that the downhole pressure is not sufficient to return the lock 10 to the locked position, and the lock 10 remains in the position shown in FIG. 3, an upward pull is then taken, as best seen in FIG. 4, on the pulling tool 100 which pulls up the mandrel 50 and shoulder 54 on the mandrel 50 forces the dogs 36 into the recess 18 thereby freeing the mandrel 50 for further upward movement.

Figure 5A:
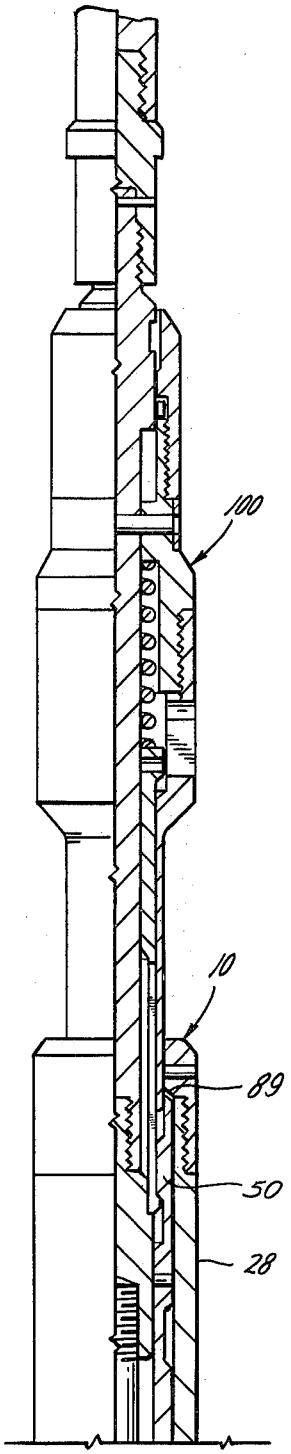
FIGS. 5A and 5B are continuations of each other of an elevational view, partly in cross section, of the well tool and locking nipple of the present invention in which the well lock is unlocked from the landing nipple and is being removed therefrom.
Figure 5B:
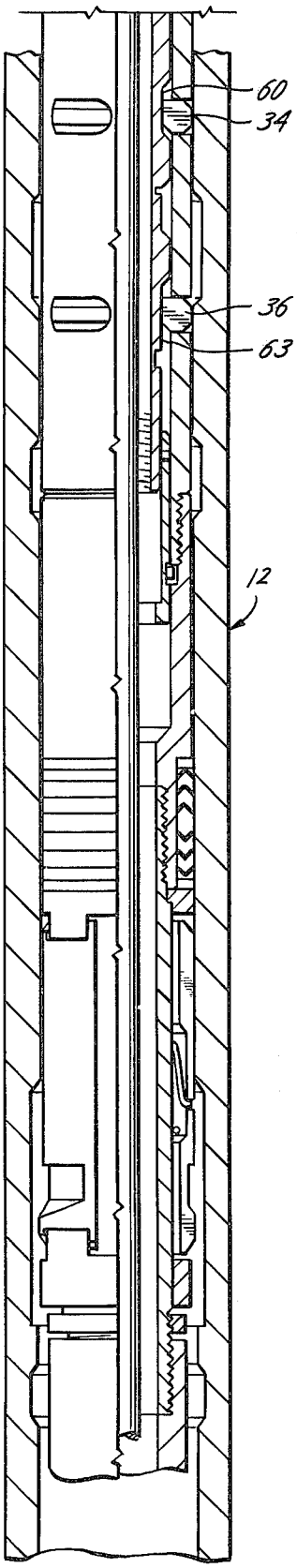

Referring now to FIGS. 5A and 5B, a further upward movement of the pulling tool 100 pulls the mandrel 50 upwardly until its upper end stops against internal shoulder 89 of the housing 28 which positions all of the shoulders on the mandrel 50 out of contact with the locking dogs 34 and 36 allowing them to retract into grooves such as 60 and 63. Further upward movement of the pulling tool 100 retrieves the well lock 10 from the landing nipple 12.

If the lock 10 cannot be moved down and retained in the position shown in FIG. 3, the mandrel 50 may be provided with a reduced cross section portion 120 which may be sheared upon a sufficient upward jar to allow upward movement of the top portion of mandrel 50 and release of the locking dogs 34 from engagement with the landing nipple 12 to provide an abnormal release.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts will readily suggest themselves to those skilled in the art and which are encompassed within the spirit of the invention and the scope of the appended claims.

What is claimed is:

1. A well lock for locking in the bore of a tubing in a well, said tubing including first and second recesses comprising, a lock housing carrying first and second locking means, seal means positioned on the exterior of the housing and adapted to seal with the bore of the tubing, locator means on the housing for positioning the first and second locking means aligned with the first and second recesses in the tubing, a mandrel positioned for telescoping movement in the housing, means on the mandrel for locking the first locking means in the first recess on longitudinal movement of the mandrel, means on the mandrel for engaging said second locking means for preventing unlocking of the first locking means if pressure is applied to the seal to move the housing upwardly, and releasable locking means between the mandrel and the housing.

2. The apparatus of claim 1 wherein the vertical spacing of the first and second locking means is less than the vertical distance between the tops of the first and second recesses and the length of the first recess is several times greater than the height of the first locking means.

3. A combination of a well lock and a locking nipple for use in well tubing comprising, a locking nipple including first and second recesses and a stop shoulder, a well lock including, a lock housing carrying first and second locking means, the vertical spacing of the first and second locking means is less than the vertical distance between the tops of the first and second recesses, seal means positioned on the exterior of the housing and adapted to seal within the locking nipple, locating means on the housing for engaging the stop shoulder of the nipple for positioning the first and second locking means aligned with the first and second recesses in the locking nipple, a mandrel positioned for telescoping movement in the housing, means on the mandrel for locking the first locking means in the first recess on longitudinal movement of the mandrel, and means on the mandrel for engaging said second locking means for preventing unlocking of the first locking means if pressure is applied to the seal to move the housing upwardly forcing the second locking means out of the second recess and toward the mandrel.

4. A well lock for locking in the bore of a tubing in a well, said tubing including a stop shoulder and first and secon recesses comprising, a lock housing having first and second openings, first and second locking means positioned in said first and second openings, respectively, seal means positioned on the exterior of the housing and adapted to seal with the bore of the tubing, stop means on said housing for engaging the tubing stop shoulder for positioning said first and second locking means aligned with the first and second recesses in said tubing, a mandrel positioned for telescoping movement in the housing, said mandrel including first and second grooves for initially allowing retraction of the first and second locking means, respectively, therein, releasable locking means between said mandrel and said housing for locking when the mandrel is raised relative to the housing, a first locking shoulder on the mandrel beneath the first groove for locking the first locking means in the first locking recess when the mandrel is raised upwardly relative to the housing and the releasable locking means is engaged, a second locking shoulder on the mandrel beneath the second groove for preventing further upward movement of the mandrel relative to the housing after the releasable locking means is engaged unless the second locking means is aligned with the second locking recess in the tubing.

5. The apparatus of claim 4 including, a third groove on the mandrel above the second locking shoulder for allowing retraction of the second locking means therein, and a third locking shoulder on the mandrel above the third groove for insuring the well tool is correctly aligned in the tubing prior to allowing upward movement of the mandrel relative to the housing.

6. The apparatus of claim 4 wherein the vertical spacing of the first and second locking means is less than the vertical distance between the tops of the first and second recesses in the tubing whereby the housing must be moved downwardly and the first and second locking means aligned with the recesses in order to release upwardly.

7. The apparatus of claim 4 wherein the length of the first recess is several times greater than the height of the first locking means.

8. A well lock for locking in the bore of a tubing in a well, said tubing including a stop shoulder and first and second recesses comprising, a lock housing having first and second openings, first and second locking means positioned in said first and second openings, respectively, and the vertical spacing of the first and second locking means being less than the vertical distance between the tops of the first and second recesses and the length of the first recess is several times greater than the height of the first locking means, seal means positioned on the exterior of the housing and adapted to seal with the bore of the tubing, stop means on said housing for engaging the tubing stop shoulder for positioning said first and second locking means aligned with the first and second recesses in said tubing, a mandrel positioned for telescoping movement in the housing, said mandrel including first and second grooves for initially allowing retraction of the first and second locking means, respectively, therein, releasable locking means between said mandrel and said housing for locking when the mandrel is raised relative to the housing, a first locking shoulder on the mandrel beneath the first groove for locking the first locking means in the first locking recess when the mandrel is raised upwardly relative to the housing and the releasable locking means is engaged, a second locking shoulder on the mandrel beneath the second groove for preventing further upward movement of the mandrel relative to the housing after the releasable locking means is engaged unless the second locking means is aligned with the second locking recess in the tubing.

9. A method of locking a well lock having first and second locking means in a tubing nipple in a well having first and second recesses comprising, moving the well lock into the nipple and aligning the first and second locking means with the first and second recesses respectively, moving a mandrel having a shoulder relative to the first locking means to place the shoulder behind the first locking means thereby locking the first locking means in the first recess, if the well pressure below the well lock is sufficient to move the well lock upwardly, moving the second locking means inwardly into engagement with the mandrel thereby holding the shoulder in a locked position behind the first locking means.

10. The method of claim 9 including the method of releasing the locked well lock from the tubing nipple comprising, moving the well lock downwardly to overcome any upward movement of the well lock because of well pressure and align the first and second locking means with the first and second recesses respectively, and if the well lock remains in the downward position, raising the mandrel to remove the shoulder from behind the first locking means thereby releasing the well lock from the nipple, and retrieving the well lock from the nipple.

* * * * *